US006257941B1

(12) United States Patent
Rhynsburger

(10) Patent No.: US 6,257,941 B1
(45) Date of Patent: Jul. 10, 2001

(54) WINDSURFING BOARD FIN PROTECTOR

(76) Inventor: Rennie L. Rhynsburger, 1475 W. 300 S., Salt Lake City, UT (US) 84104

( * ) Notice: Subject to any disclaimer, the term of this patent is extended or adjusted under 35 U.S.C. 154(b) by 0 days.

(21) Appl. No.: 09/553,426

(22) Filed: Apr. 19, 2000

(51) Int. Cl.[7] ..... B63B 1/00; B63B 35/00

(52) U.S. Cl. ..... 441/79

(58) Field of Search ..... 441/74, 79

(56) References Cited

U.S. PATENT DOCUMENTS

| | | | | |
|---|---|---|---|---|
| D. 292,752 | | 11/1987 | Reinhardt . | |
| 3,374,495 | * | 3/1968 | Joyce | 441/74 |
| 4,320,569 | | 3/1982 | Todd, Sr. . | |
| 4,759,483 | | 7/1988 | Willoughby . | |
| 4,792,316 | | 12/1988 | Skedeleski et al. . | |
| 5,009,348 | | 4/1991 | Derkatz . | |
| 5,094,344 | * | 3/1992 | Savage | 206/315.1 |
| 5,147,235 | * | 9/1992 | Bamburak et al. | 441/79 |
| 5,474,256 | | 12/1995 | Garner . | |
| 6,135,836 | * | 10/2000 | Rhynsburger | 441/74 |

OTHER PUBLICATIONS

The House 1999 mail order catalog, p. 24, showing Finshield fin protector. The House, St. Paul, Minnesota.

Photograph copies of DaKine Hawaii Fin Protector.

Photograph copies of Mistral Race cover.

* cited by examiner

*Primary Examiner*—Ed Swinehart
*Assistant Examiner*—Andrew Wright
(74) *Attorney, Agent, or Firm*—Mallinckrodt & Mallinckrodt; Robert R. Mallinckrodt

(57) ABSTRACT

A fin protector for a wind surfing board or similar item includes two sides secured together to form a pocket or receiving opening for the tip of a fin to be protected. Anti-scratch standoffs or spacers extend from the sides into the fin receiving opening to space the sides from the fin as the tip of the fin is inserted. The fin is inserted into the pocket far enough to flex the sides apart enough so that the sides, through the spaces, press against the fin and hold the protector on the fin. The standoffs or spacers may take the form of hooks of hook and loop fastening material with pieces of the hook material secured to the sides of the fin receiving opening so the hooks extend into the opening, or may take the form of ridges extending from the sides of the fin receiving opening into the opening. The spacers provide a space between the sides of the fin receiving opening and the surface of the fin received therein where sand or other abrasive foreign material can rest to lessen the chances of such material scratching the fin surface.

17 Claims, 4 Drawing Sheets

WINDSURFING BOARD FIN PROTECTOR

BACKGROUND OF THE INVENTION

1. Field

Figures 1, 2:
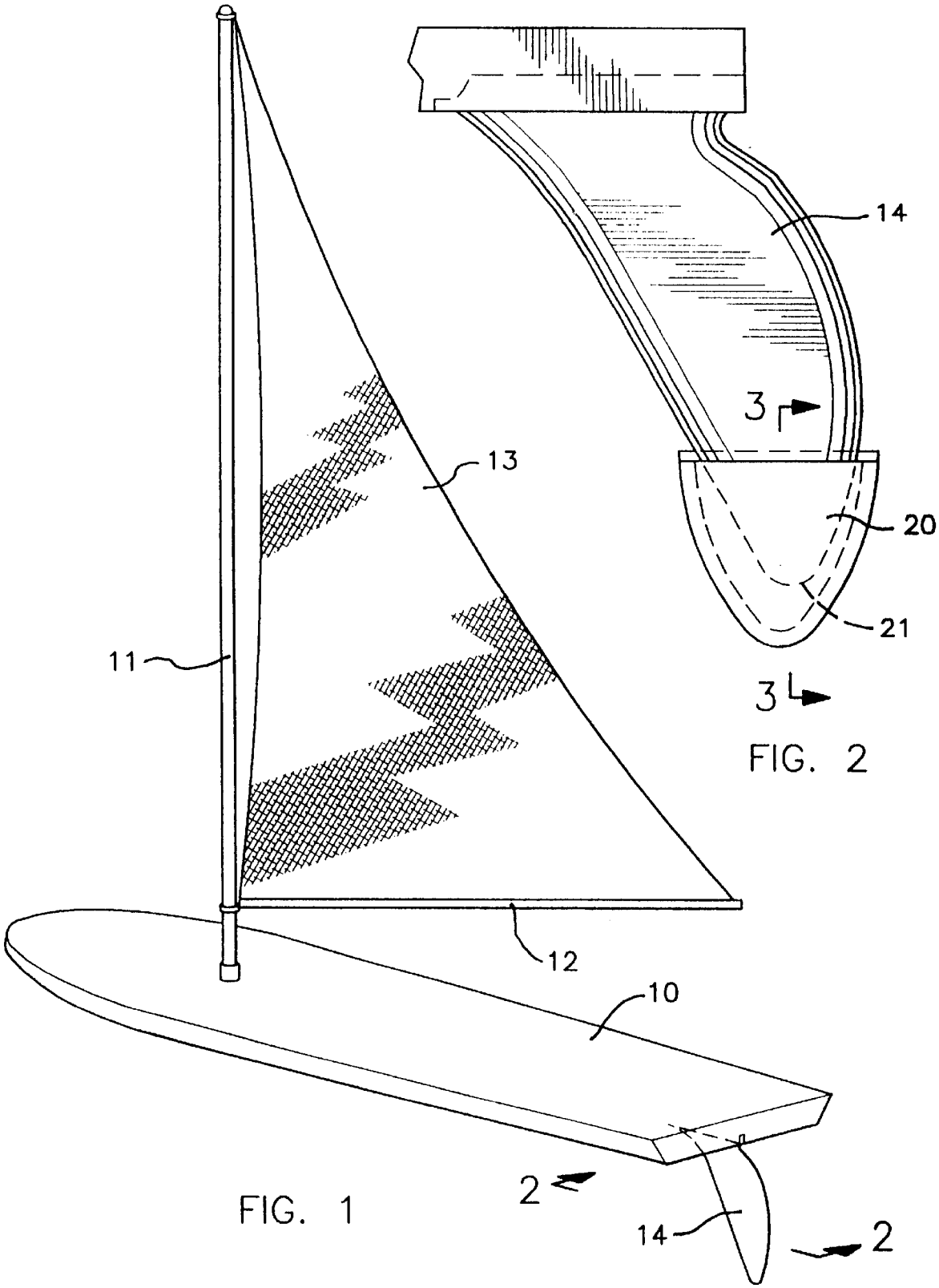

The invention is in the field of protectors for the fins of windsurfing boards or the like.

2. State of the Art

A windsurfing board is similar to a surfboard, but with a mast and sail. A fin extends from the rearward bottom of the board. When windsurfing, it is common to keep the windsurfing board on a beach until the right conditions occur and the board is put into the water for use. After use in the water, it is again pulled onto the beach until used again in the water or taken for transportation and/or storage. When on the beach, the board usually rests on its fin, which can damage the lower edge of the fin where the board rests. As the boards and fins become more refined, even small nicks and minor damage to the edges and lower surface of the fins can have an adverse effect on the board's performance. It is therefore desirable to protect the fins during transportation and storage and during the time a board is set on a beach waiting for use or between uses.

Currently available fin protectors are made of a soft EVA foam or similar material which fits over a fin to protect it. With a soft material, when the board is set down with the fin on a beach or other hard surface, damage can still occur through the soft foam material. Further, the foam material wears through relatively quickly at the bottom of the fin leaving the bottom of the fin exposed to damage. In addition, the prior art fin protectors have a tendency to fall off the fin when the board is moved.

In my copending application Ser. No. 09/379,259, filed Aug. 23, 1999, I disclose a fin protector made of a semi-rigid or substantial rigid material in the form of a pocket which fits over and accepts the lower portion of the fin therein. The fin protector is held in place on the fin by frictional engagement of the material forming the fin protector and the sides of the fin. However, in some instances a grain or two of sand, if on a sandy beach, becomes positioned between the fin protector wall and the fin and will scratch the fin. This is undesirable and part of what a fin protector should prevent.

SUMMARY OF THE INVENTION

According to the invention, a fin protector is made of a semi-rigid or substantially rigid material in the form of a pocket with anti-scratch standoffs or spacers therein. The pocket fits over and accepts the lower portion of the fin therein with the sides of the pocket spaced from the surface of the fin by the spacers. The action of the pocket walls in conjunction with the spacers against the fin holds the pocket onto the fin so the pocket does not normally fall off. The pocket can be easily pulled off the fin when it is desired to use the board and replaced on the fin when the board is brought out of the water and placed on the beach or otherwise transported or stored. The spacers in spacing the walls of the pocket from the sides of the fin create a place between the pocket walls and fin surface for grains of sand or other similar items to rest that might otherwise scratch the surface of the fin as the pocket is slid over the fin or removed from the fin.

The pocket is preferably formed of a plastic material which is soft enough to flex and receive and go over, but not damage, the fin, yet rigid enough that it will cause the spacers to grip and normally stay on the fin once the pocket is placed thereon. A low density polyethylene or a fiber filled polyvinylchloride has been found satisfactory for the pocket walls. The pocket may be formed from two sheets of suitable material cut to a pocket shape and secured together along their edges. This can be done by gluing, riveting, stapling, sewing, or similarly securing the pieces together or a combination of the above. The pocket can also be injection molded as a single piece.

The spacer material may be any material that will hold the sides of the pocket away from the fin just enough to prevent scratching of the fin by sand or other material that would be expected to get onto the fin or into the pocket during normal use of the windsurfing board and fin protector. The spacer material should also be soft enough that it can rub against the fin surface as the fin is inserted into the pocket or as the pocket is removed from the fin without scratching or damaging the fin. A presently preferred material which has been found to work well is the hook portion of hook and loop fastening material such as the hook portion of VELCRO material. It has been found that the hooks are strong enough to space the sides of the pockets from the fin sufficiently to provide space among the hooks to receive and hold sand and keep it from scratching the fin. Thin vertical spacer ridges extending inwardly from the pocket sides are also satisfactory and are preferred with an injection molded pocket where the spacer ridges are molded with and are part of the pocket.

THE DRAWINGS

Figure 4:
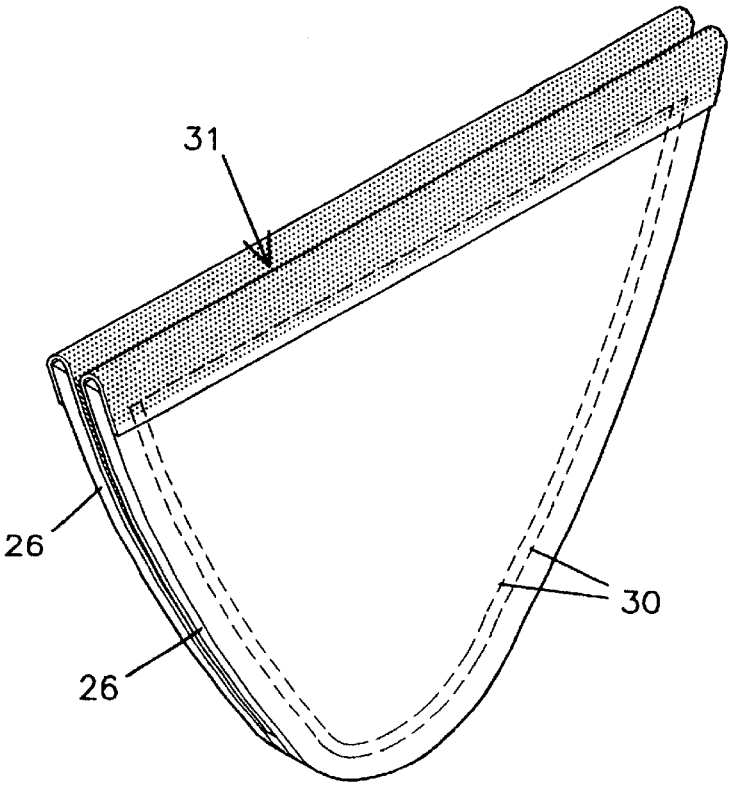
Figure 3:
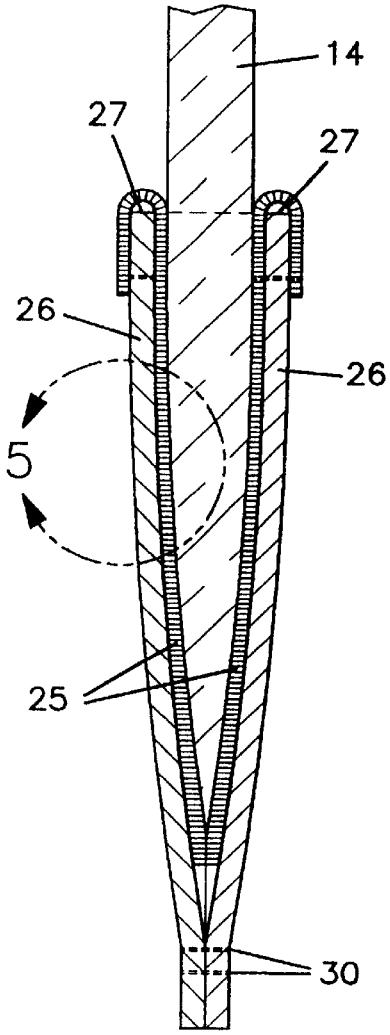
Figure 5:
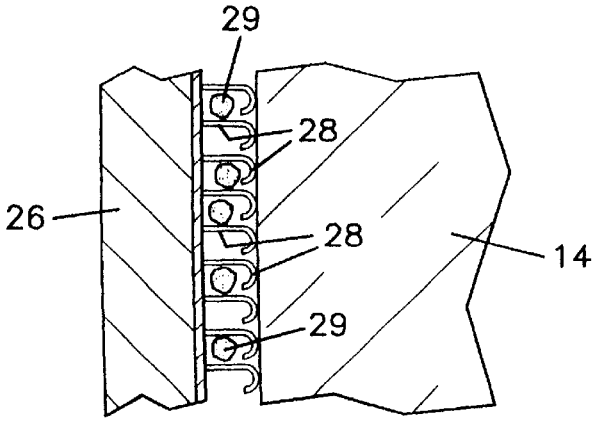
Figure 6:
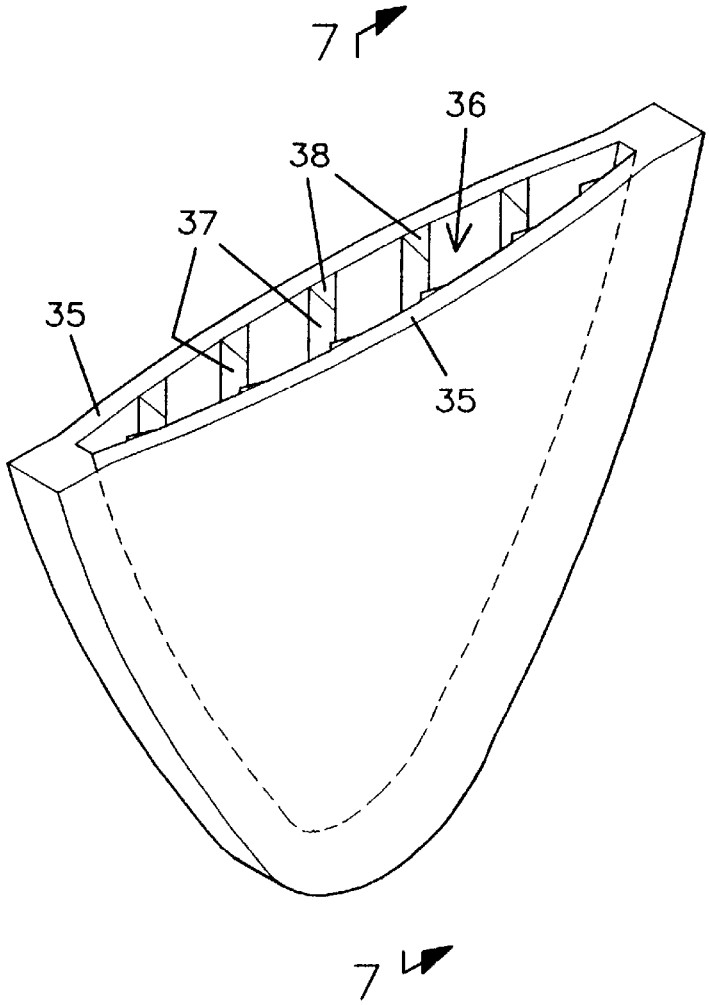
Figure 7:
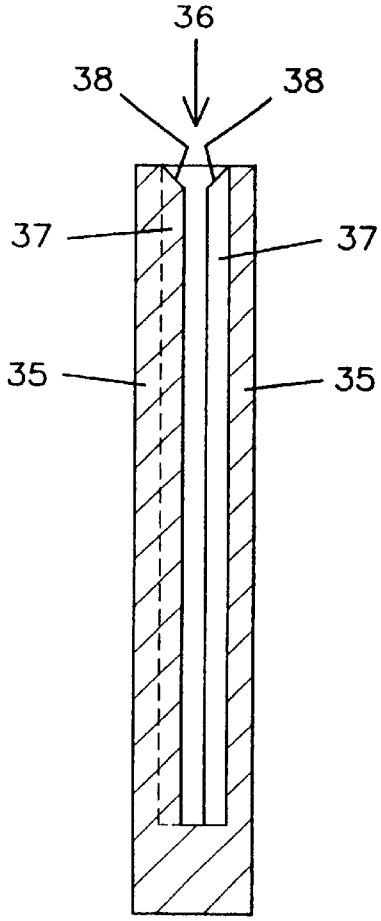
Figure 8:
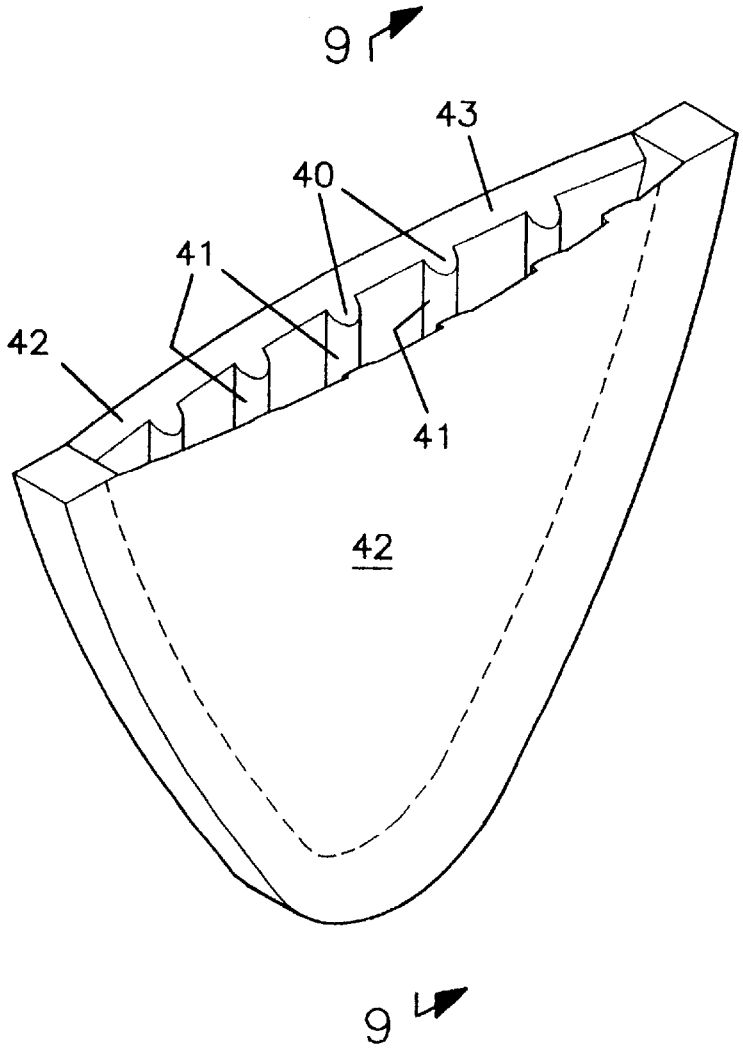
Figure 9:
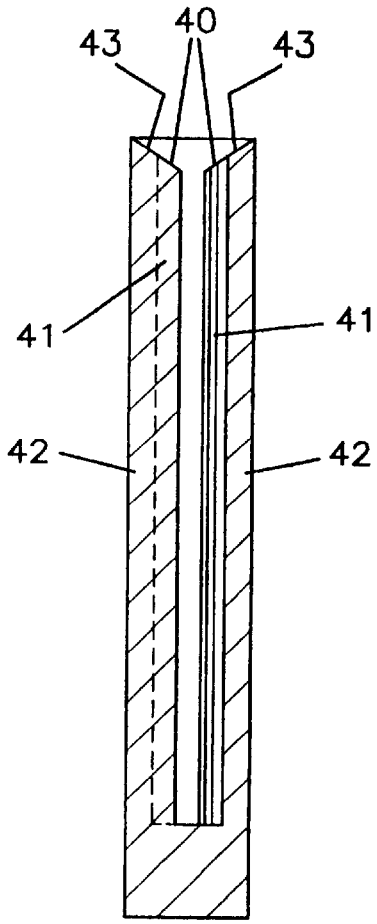

The best presently contemplated for carrying out the invention is illustrated in the accompanying drawings, in which:

FIG. 1 is a pictorial and somewhat schematic representation of a windsurfing board showing a bottom fin to be protected;

FIG. 2 a side elevation of a windsurfing board fin such as taken on the line 2—2 of FIG. 1, but not showing the board, and showing the fin Protector of the invention in place thereon;

FIG. 3, a vertical section through the fin and fin protector taken on the line 3—3 of FIG. 2;

FIG. 4, a pictorial view of the fin protector of FIG. 3;

FIG. 5, an enlargement of the portion of FIG. 3 encircled by arrow 5—5, FIG. 6, a pictorial view of an injection molded embodiment of the fin protector;

FIG. 7, vertical section taken on the line 7—7 of FIG. 6;

FIG. 8, a pictorial view of a further embodiment of an injection modeled fin protector; and FIG. 9, a vertical section taken on the line 9—9 of FIG. 8.

DETAILED DESCRIPTION OF THE ILLUSTRATED EMBODIMENTS

Windsurfing boards generally consist basically of a board 10, FIG. 1, similar to a surf board, with a mast 11 and boom 12 mounting a sail 13. The board 10 has a stabilizing fin 14 extending from the rearward bottom of the board.

In use, it is normal practice for a person windsurfing to put the board down on the beach with the bottom of the fin resting on the beach to support the rear end of the board while waiting for the right windsurfing conditions or while resting. Also, in storage or in transporting the board, the board can be put down to rest on its fin. While putting the fin down on a sandy beach may not damage the fin, if rocks are present or the board is put down on a hard surface, damage to the fin edge can result. It is thus desirable in most instances to protect the fin when it is resting on a surface.

The present invention provides a fin protector 20, FIG. 2, in the form of a pocket which fits over the bottom portion of fin 14. The protector 20 is made of a semirigid or substantially rigid material forming walls with a fin receiving opening therebetween and the bottom of which will rest on a supporting surface and separate and hold the bottom of the fin 21 above and off the surface, thus protecting the bottom 21 of the fin 14. Anti-scratch standoffs or spacers are provided inside the pocket, i.e., inside the fin receiving opening, to separate the inside surfaces of the walls forming the pocket from the fin to reduce the chance foreign material, such as sand, might enter the pocket and lodge between the inside surface of the pocket and the fin thereby scratching the fin surface. The spacers provide room between the fin and pocket walls for such materials to lodge. Any semirigid or substantially rigid material may be used for the protector, but the material must flex to the extent that the walls will separate and flex to open the pocket as the fin is inserted into the pocket without crushing the spacers. It, and the spacers, must be rigid enough so that when the fin is inserted into the pocket, the spacers grip the fin and hold the pocket on the fin so it does not easily fall off. Further, the pocket must be rigid enough that it supports and separates the bottom of the fin from a resting surface. In addition, any material touching the fin must be soft enough so that upon insertion of the fin it does not scratch or damage the fin. A low density polyethylene material or a fiber filled polyvinylchloride (PVC) material has been found satisfactory for the pocket walls.

The standoffs or spacers may take various forms, and may conveniently be a layer of spacer material 25, FIG. 3, lining the inside of pocket walls 26. The spacer material 25 may extend up to the tops 27 of pocket walls 26, or may extend up and over the tops 27 of pocket walls 26 as shown in FIGS. 3 and 4. It has been found that the hook material of a hook and loop fastener, such as VELCRO, is particularly effective as a spacer material and the hooks 28, FIG. 5, extend and remain substantially extended enough when the fin is inserted into the pocket to space the pocket walls from the fin a distance sufficient to prevent scratching of the fin surface by sand grains 29 or other abrasive foreign materials that may enter the pocket. It also allows such foreign material to be easily rinsed from the pocket when the pocket is removed from the fin. In some cases, opening the pocket slightly during rinsing helps to insure that all foreign material is removed. The pocket can be easily opened by inserting a blade or similar flat instrument into the pocket and turning it to spread the sides and open the pocket. Of course, where various hook materials may be available, the hook material has to be chosen so that it has the necessary strength to separate and hold the pocket sides away from the fin. Some deformation of the hooks may occur, but complete crushing of the hooks should be avoided.

With the spacer material extending to the top of the pocket, i.e., through the entrance to the fin receiving opening, or over the top of the pocket as shown in FIGS. 3 & 4, such material holds the sides of the pocket somewhat open so the fin may be easily inserted into the pocket.

While the hook portion material of hook and loop fastening material is presently preferred as the spacer material, various other materials could also be used such as bristle material, plastic foams, or similar materials which provide similar results.

The protector may be made of two pieces of material, such as polyethylene sheet material, cut to shape, and joined along their edges. One-eighth inch thick polyethylene sheet material has been found satisfactory. The pieces may be joined along sections of their circumferential edge portions in any satisfactory manner such as by gluing, riveting, sewing, stapling, etc. With polyethylene material which is difficult to glue, it is preferred that the pieces be mechanically held together. They can, in addition to the mechanical fastening, also be glued, if desired. As shown in FIGS. 3 and 4, the pieces of material 26 forming the sides of the pockets may be stitched together by stitching 30 along their edges except for the top edge having pocket opening or entrance 31 which has to remain open.

The fin protector may be injection molded to a form as shown in FIG. 6 with protector sides 35 forming an inner fin receiving pocket opening 36 into which the fin is inserted. Spacer ridges 37 are molded into the inner faces of walls 35 and extend inwardly to contact the fin surface when the pocket is placed over the fin tip. The tops 38 of ridges 37 may be beveled or sloped downwardly to aid in inserting the fin. The pocket may be formed with some open area shown as 36 into which the bottom of the fin can be initially inserted. However, the opening between spacers is normally narrower than the thickness of the fin. The protector is then pushed onto the fin so the fin extends into the pocket which causes the opposite sides 35 of the protector to flex and ridges 37 to frictionally engage the fin side surfaces to hold the protector on the fin. The protector will hold and support a fin above a surface with the protector sides transmitting supporting forces to the fin sides while relieving supporting force from the fin tip edge.

The spacer ridges may have various configurations. FIG. 6 shows a substantially triangular configuration while FIG. 8 shows a rounded or semicircular configuration. Various other configurations, such as flat spacers, could be used. The ridges are shown as interweaved, but do not have to be. Further, such spacer ridges can be used with the various constructions of pockets such as the two piece construction of FIGS. 3–5, or hooks of hook and loop material (or other spacer material) could be used in the molded embodiment such as by forming an insert pocket of such material and securing it, such as by gluing, into the fin receiving opening in the pocket.

It should be realized that while a shape somewhat conforming to the shape of the lower portion of the fin has been shown, various shapes could be used for the protector as long as the protector hangs onto a fin and protectively supports and hold the fin tip edge above a surface. Further, while various spacers and types of spacer materials may be used, it has been found that a space between the sides of the pocket and the fin of about one-sixteenth to one-eighth inch is satisfactory. VELCRO hook material about one-sixteenth inch thick (hooks extend from the material slightly less than about one-sixteenth inch) has also been found satisfactory. Of course, the satisfactory thickness will depend to some extent and may vary according to the expected conditions of use of the protector. In addition, the protector can be used for surfboards or other similar or like items as well as windsurfing boards and for purposes of this application, are considered equivalent to windsurfing boards.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. A fin protector for protecting the fin tip edge of a fin for windsurfing boards and the like, comprising:

a pair of protector sides secured together to form a fin receiving opening therebetween; and spacers extending from the protector sides into the fin receiving opening to space the protector sides from the fin when the fin is inserted into the fin receiving opening;

said fin receiving opening and spacers being configured so that the protector sides are flexed as the fin is inserted into the fin receiving opening to an extent to clamp and hold the fin protector on the fin, the fin protector being rigid enough to support and hold the fin above a surface upon which the protector may rest without supporting force being applied to the fin tip edge.

2. A fin protector according to claim 1, wherein the fin has fin sides and wherein the protector sides transmit through the spacers supporting force to the fin sides.

3. A fin protector according to claim 2, wherein the protector sides have circumferential edges and circumferential edge portions along and adjacent to the edges, and wherein the protector sides are secured together along sections of their respective circumferential edge portions.

4. A fin protector according to claim 3, wherein the fin protector is injection molded and the sides are secured together by being molded together.

5. A fin protector according to claim 3, wherein the spacers are hook and loop fastener hooks extending inwardly from the protector sides.

6. A fin protector according to claim 5, wherein the hooks are provided by hook material secured to the protector sides.

7. A fin protector according to claim 6, wherein the fin receiving opening has an entrance and the hook material extends through the entrance.

8. A fin protector according to claim 3, wherein the spacers are a plurality of ridges extending substantially vertically in the fin receiving opening.

9. A fin protector according to claim 8, wherein the ridges extend into the fin receiving opening from opposite protector sides and the ridges extending from the opposite sides are interweaved.

10. A fin protector according to claim 8, wherein the ridges extend to an entrance to the fin receiving opening and are beveled at the opening to aid insertion of the fin into the fin receiving opening.

11. A fin protector according to claim 10 wherein the entrance to the fin receiving opening is formed by edges of the protector sides and such edges are beveled to aid insertion of the fin into the fin receiving opening.

12. A fin protector according to claim 1, wherein the entrance to the fin receiving opening is formed by edges of the protector sides and such edges are beveled to aid insertion of the fin into the fin receiving opening.

13. A fin protector according to claim 1, wherein the spacers are hook and loop fastener hooks extending inwardly from the protector sides.

14. A fin protector according to claim 13, wherein the hooks are provided by hook material secured to the protector sides.

15. A fin protector according to claim 1, wherein the spacers are a plurality of ridges extending substantially vertically in the fin receiving opening.

16. A fin protector according to claim 15, wherein the ridges extend into the fin receiving opening from opposite protector sides and the ridges extending from the opposite sides are interweaved.

17. A fin protector according to claim 16, wherein the ridges extend to an entrance to the fin receiving opening and are beveled at the opening to aid insertion of the fin into the fin receiving opening.

* * * * *